US009338546B2

(12) United States Patent
Straeussnigg et al.

(10) Patent No.: US 9,338,546 B2
(45) Date of Patent: May 10, 2016

(54) CIRCUIT ASSEMBLY FOR PROCESSING AN INPUT SIGNAL, MICROPHONE ASSEMBLY AND METHOD FOR FOLLOWING AN INPUT SIGNAL

(71) Applicant: Infineon Technologies AG, Neubiberg (DE)

(72) Inventors: Dietmar Straeussnigg, Villach (AT); Andreas Wiesbauer, Poertschach (AT); Elmar Bach, Villach (AT)

(73) Assignee: Infineon Technologies AG, Neubiberg (DE)

( * ) Notice: Subject to any disclaimer, the term of this patent is extended or adjusted under 35 U.S.C. 154(b) by 136 days.

(21) Appl. No.: 14/107,965

(22) Filed: Dec. 16, 2013

(65) Prior Publication Data

US 2015/0172826 A1 Jun. 18, 2015

(51) Int. Cl.

*H04R 3/00* (2006.01)
*H04R 19/00* (2006.01)
*H04R 19/04* (2006.01)

(52) U.S. Cl.

CPC ..... *H04R 3/00* (2013.01); *H04R 19/005* (2013.01); *H04R 19/04* (2013.01); *H04R 2201/003* (2013.01); *H04R 2499/11* (2013.01)

(58) Field of Classification Search

CPC ..... H04R 3/00; H04R 19/00; H04R 19/005; H04R 31/00; H04R 2201/003; H03F 3/187; H03F 2200/504; H03F 2200/516; H03F 2200/555; H03G 3/004; B81B 2201/0257; B81B 3/0035; B81C 1/00158; B81C 1/00166; B81C 1/00182

See application file for complete search history.

(56) References Cited

U.S. PATENT DOCUMENTS 4,491,697 A * 1/1985 Tanaka ..... H04R 19/016 330/269
7,411,438 B2 * 8/2008 Hebert ..... H03F 1/02 326/80
8,362,838 B2 * 1/2013 Tucker ..... H03F 1/0222 330/297
8,526,656 B2 * 9/2013 Tanaka ..... H04R 1/38 381/163
8,605,919 B2 * 12/2013 Awamura ..... H04R 1/06 381/174
8,750,533 B2 * 6/2014 Oddoart ..... H04R 3/00 381/74
8,774,428 B2 * 7/2014 Jaar ..... H04R 3/00 381/111
8,872,589 B2 * 10/2014 Draxelmayr ..... H03F 3/005 330/260
9,042,578 B2 * 5/2015 Dunser ..... H03F 1/52 381/120
9,048,790 B1 * 6/2015 Refaeli ..... H03F 3/181

(Continued)

FOREIGN PATENT DOCUMENTS

DE 102012110737 A1 5/2014
DE 102013108573 A1 2/2015

(Continued)

*Primary Examiner* — Matthew Eason
(74) *Attorney, Agent, or Firm* — Slater Matsil, LLP

(57) ABSTRACT

A circuit assembly and a method for processing an input signal are disclosed. In one embodiment a circuit assembly comprises a voltage provider configured to receive a supply voltage and to provide an internal supply voltage higher than the supply voltage and a signal follower coupled to an output port of the voltage provider, the signal follower being configured to receive the internal supply voltage and the input signal, and to provide an output signal depending on the input signal.

12 Claims, 7 Drawing Sheets

(56) References Cited

U.S. PATENT DOCUMENTS

| | | | | |
|---|---|---|---|---|
| 9,118,291 | B2 * | 8/2015 | Wu | H03F 1/0244 |
| 9,209,767 | B1 * | 12/2015 | Svendsen | H03G 3/004 |
| 2007/0057602 | A1 * | 3/2007 | Song | H04R 31/006 310/328 |
| 2008/0144861 | A1 * | 6/2008 | Melanson | H03F 1/025 381/120 |
| 2010/0158274 | A1 * | 6/2010 | Suvanto | H03G 3/004 381/103 |
| 2012/0133432 | A1 * | 5/2012 | Gehrke | H03G 1/0088 330/131 |
| 2012/0224726 | A1 * | 9/2012 | Pahl | H04R 1/04 381/174 |
| 2014/0132433 | A1 | 5/2014 | Straeussnigg et al. | |
| 2015/0042496 | A1 | 2/2015 | Straeussnigg et al. | |

FOREIGN PATENT DOCUMENTS

| | | | |
|---|---|---|---|
| KR | 20010044497 | A | 6/2001 |
| KR | 101094397 | B1 | 12/2011 |

* cited by examiner

CIRCUIT ASSEMBLY FOR PROCESSING AN INPUT SIGNAL, MICROPHONE ASSEMBLY AND METHOD FOR FOLLOWING AN INPUT SIGNAL

TECHNICAL FIELD

Embodiments of the present invention relate to a circuit assembly and a method for processing an input signal.

BACKGROUND

Requirements for microphones have risen due to increasing sound levels that are to be processed. For some applications today, processing of sound levels up to 140 dBSPL has to be achieved. This may increase a dynamic range to be covered by a signal path, which in turn may affect an application specific integrated circuit (ASIC) configured to process a microphone signal. Conventional solutions to process high levels of sound, for example, between 120 and 140 dBSPL, may thus lead to an increase of stiffness of a membrane of the microphone. This may, however, decrease an achievable signal-to-noise ratio to an unacceptable extent.

It is hence desirable to improve a concept for processing an input signal from a microphone.

SUMMARY OF THE INVENTION

According to one aspect, it is provided a circuit assembly for processing an input signal. The circuit assembly comprises a voltage provider configured to receive a supply voltage and to provide an internal supply voltage higher than the supply voltage. The circuit assembly also comprises a signal follower coupled to an output port of the voltage provider. The signal follower is configured to receive the internal supply voltage and the input signal, and to provide an output signal depending on the input signal.

According to another aspect, embodiments refer to a microphone assembly. The microphone assembly comprises a microphone configured to provide a raw microphone signal. The microphone assembly further comprises a circuit assembly for processing an input signal. This circuit assembly comprises a voltage provider configured to receive a supply voltage and to provide an internal supply voltage higher than the supply voltage. The microphone assembly also comprises a signal follower configured to receive the internal supply voltage and the raw microphone signal as an input signal, and to provide an output signal depending on the input signal.

One or more embodiments are further related to a method for following an input signal. The method comprises a receiving of a supply voltage. The method also comprises a providing of an internal supply voltage using the supply voltage, the internal supply voltage being higher than the supply voltage. The method further comprises a receiving of the input signal. Furthermore, the method comprises a providing of an output signal, the output signal depending on the input signal and the internal supply voltage.

Some embodiments comprise a digital control circuit installed within the apparatus for performing the method. Such a digital control circuit, e.g., a digital signal processor (DSP), needs to be programmed accordingly. Hence, further embodiments also provide a computer program having a program code for performing embodiments of the method, when the computer program is executed on a computer or a digital processor.

BRIEF DESCRIPTION OF THE DRAWINGS

Some embodiments of apparatuses and/or methods will be described in the following by way of example only, and with reference to the accompanying figures, in which.

Various example embodiments will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the embodiments of the invention. Like numbers refer to like or similar elements throughout the description of the figures.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

DETAILED DESCRIPTION OF ILLUSTRATIVE EMBODIMENTS

Figure 1:
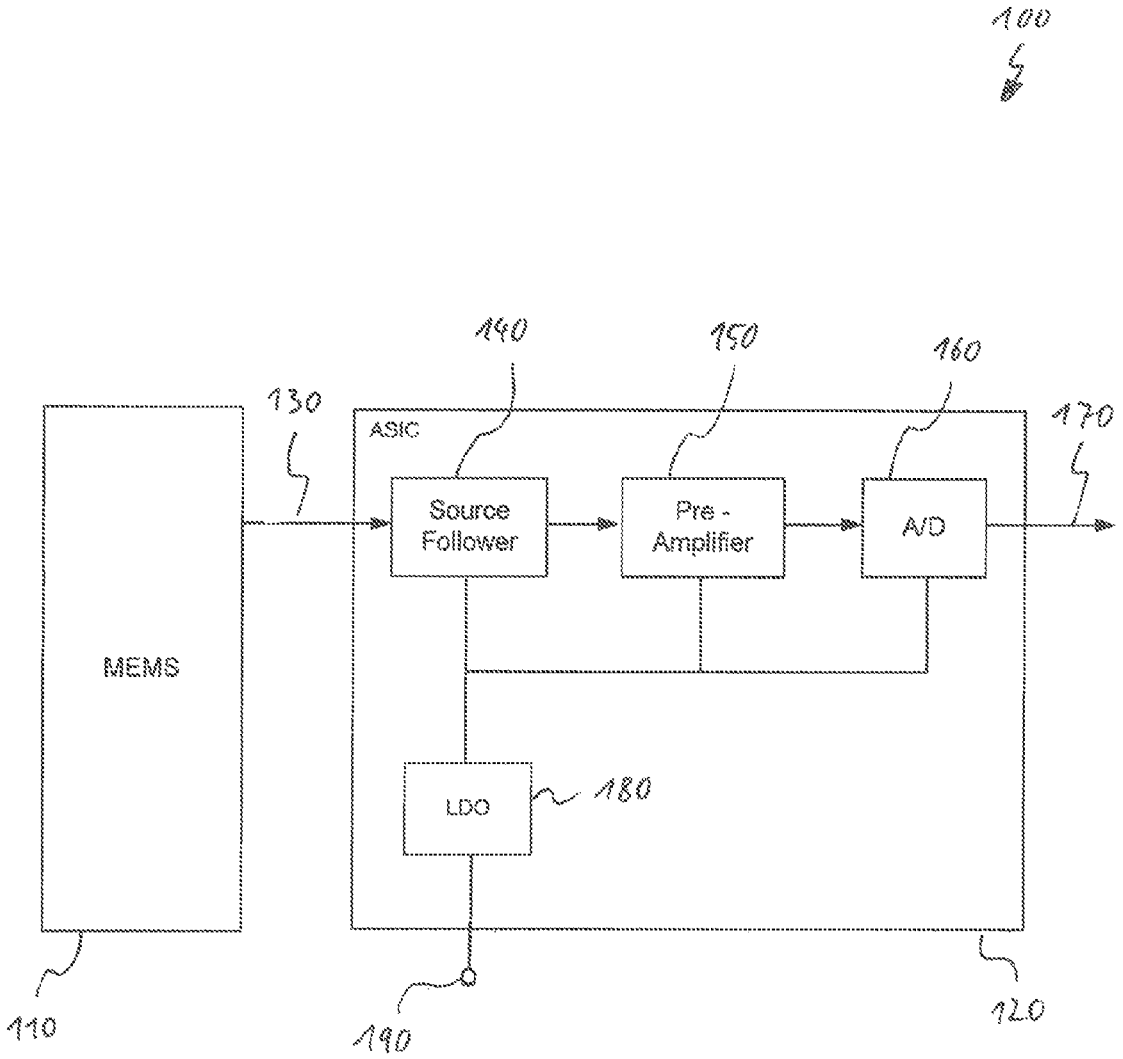
Fig. 1 Prior Art
FIG. 1 shows a block diagram of a circuit assembly and a microphone according to a conventional solution.

FIG. 1 shows a block diagram of a circuit assembly 100 according to a conventional solution. The assembly 100 comprises a microelectromechanical system 110 (MEMS) and an application specific integrated circuit 120 (ASIC). The MEMS 110 may comprise a means configured to receive an acoustic signal and provide a corresponding electric input signal 130 to the ASIC 120. The ASIC 120 further comprises a source follower 140, a pre-amplifier 150 and an analog-to-digital converter 160 (ADC or A/D), through which the signal is processed and thereafter provided as an electric output signal 170. The source follower 140, pre-amplifier 150 and ADC 160 are coupled to a low-dropout regulator 180 (LDO), the LDO 180 being comprised by the ASIC 120. The LDO 180 is configured to receive an external supply voltage 190 and perform regulation, or, in other words stabilize the supply voltage 190 before it is provided to the source follower 140, pre-amplifier 150 and ADC 160, respectively. The supply voltage may for instance be 1.8 V.

The source follower 140, which is also called a "buffer" herein, may be used to read out or receive the input signal 130 from the MEMS 110 with a high resistivity. The pre-amplifier 150 is configured to amplify the signal before it is converted from analog to digital domain by the ADC 160. To date, signals of up to 120 dBSPL may be processed with the assembly 100 at sufficient quality. However, to fulfill higher requirements for the dynamic range, for example, due to signals having a strength of more than 120 dBSPL, the resulting quality of the output signal 170 may often diverge from a customer's expectations. In order to increase the signal quality, several conventional solutions may be carried out. One simple approach may be to increase the value of the supply voltage 190, which, however, may be undesirable, for example, for economic reasons.

Another conventional solution may comprise a decrease of signal strength before the input signal 130 is provided to the source follower 140 and an increase after the output signal 170 has been provided by the ADC 160, e.g., in the digital domain. Artificial compression of the input signal 130 of the source follower, however, may lead to undesirably high signal-to-noise ratio (SNR). In other words, signal strength may be limited for signals provided to the ASIC 120, and the limitation may be compensated at the end of the signal path again. However, the source follower 140 exhibits a high input resistivity. Hence, it may react sensitively to changes at its input, which might propagate to its output and introduce additional noise into the signal.

Turning now to FIGS. 2 to 6, embodiments related to a circuit assembly 200 for processing an input signal 230 are illustrated. The circuit assembly 200 comprises a voltage provider 300 to receive a supply voltage 290 and to provide an internal supply voltage 310 higher than the supply voltage 290. The circuit assembly 200 also comprises a signal follower 240 (which is also referred to as a buffer) configured to receive the internal supply voltage 310 and the input signal 230, and to provide an output signal 270 depending on the input signal 230. In some embodiments, the signal follower 240 and the voltage provider 300 may optionally be implemented on an ASIC 220.

The voltage provider 300 may, for example, be a voltage multiplier 300. The signal follower 240 may be a device providing an output signal, which corresponds to an input signal received by said device. For example, the signal follower 240 may be a source follower 240. The input signal 230 may, for example, be a microphone signal 230 provided by a microphone. These embodiments are also shown in FIGS. 2 to 6. It is to be understood, however, that said embodiments are merely exemplary and are not to be regarded as being constrictive.

A MEMS 210 may receive an acoustic signal and in reaction provide the input signal 230 to the ASIC 220, which comprises the source follower 240. The SNR may present a measurement for the quality of an output such as the microphone signal 270 provided by the source follower 240 after processing. For instance, a low SNR may result in a low-quality output. In the case of a strong input signal 230 (for instance, having more at least 120 dBSPL) it may be helpful to reduce the amount of noise even further than in the case of a weaker signal (for instance, having less than 120 dBSPL). The source follower 240 may have significant influence on the SNR depending on the (internal) supply voltage provided to the source follower 240. In other words, a reduction of a supply voltage value may notably decrease the SNR. Embodiments may thus present the possibility to apply a comparatively low supply voltage 290 (e.g., 1.8 V) to the circuit assembly 200, which comprises the voltage multiplier 300. The voltage multiplier 300 may receive the supply voltage 290 and provide a comparatively stronger internal supply voltage 310 (e.g., 3.6 V) to the source follower 240. This way the supply voltage 290 may be kept low while an undesirably high SNR may be avoided. Through embodiments, processing of stronger signals (HSPL applications) may be possible.

The voltage multiplier 300 may be any kind of electric component, which may allow an increase in an electric voltage, for example, a doubling, while leaving an electric current value unchanged. The voltage multiplier 300 may, for instance, act like an additional voltage source, or, in other words, generate additional voltage. The voltage multiplier 300 may, for example, comprise a capacitor or a battery. Components, for which a higher supply voltage may be helpful, may be individually provided with an increased voltage. This way, constraints resulting from a limited external supply voltage may be reduced.

Figure 2:
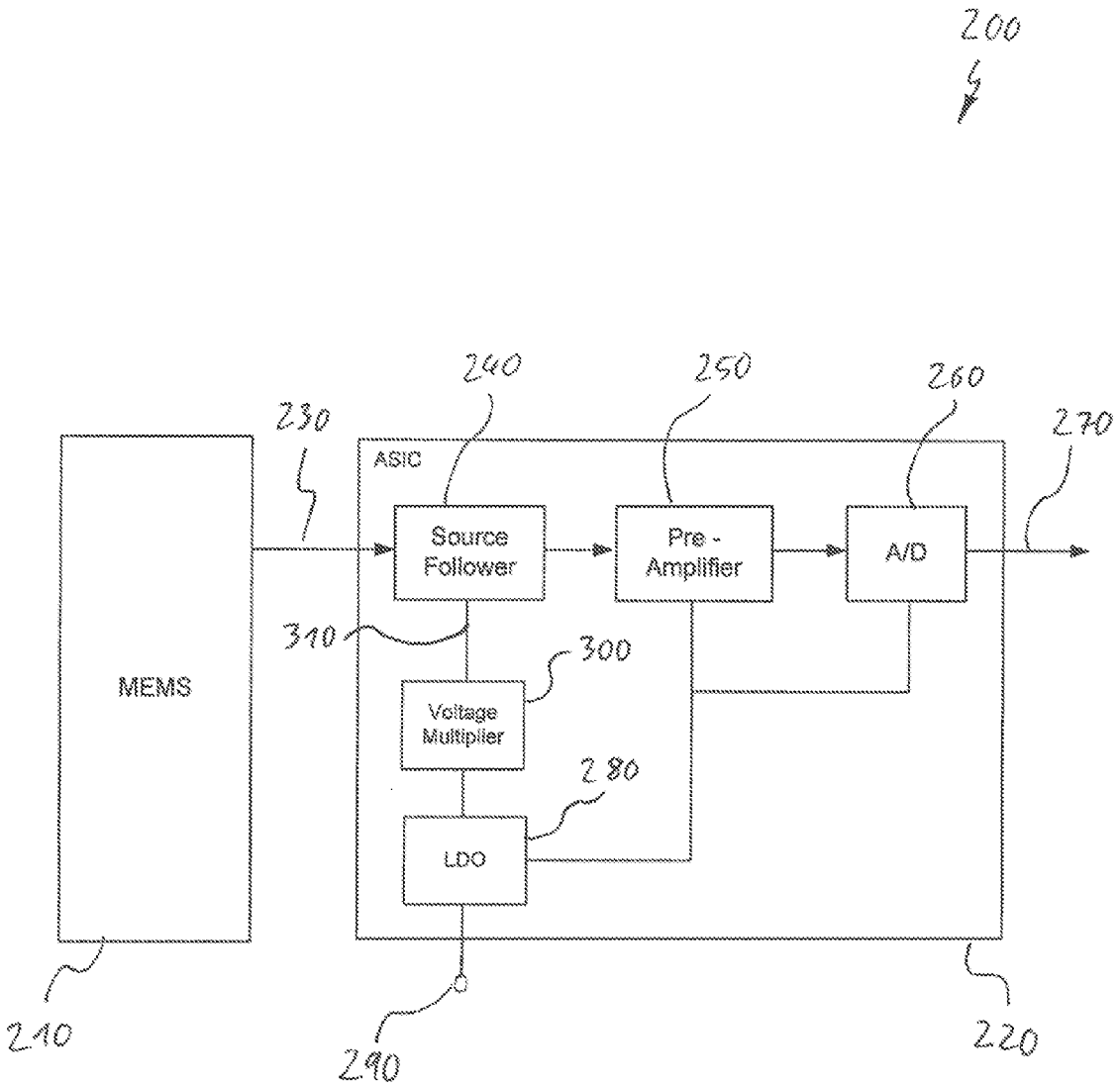
FIG. 2 shows a block diagram of a circuit assembly for processing an input signal from a microphone according to a first embodiment.

Following a path of the input signal 230, one or more nodes of low impedance comparative to the source follower 240 may be implemented behind the source follower 240. The node or nodes may be at least one analog module 255, as is shown in FIGS. 3 to 6. The supply voltage 290 may in some embodiments be provided to the analog module 255. The analog module 255 may be comprised by the ASIC 220. The analog module 255 may, for instance, be an amplifier 250, as is shown in FIG. 2. Furthermore, the analog module 255 may receive the input signal 230 from the source follower 240, perform a process such as an amplification of the signal, and provide the signal altered by the process to another analog module or as an output signal 270. The low impedance of the node may offer the possibility to imply a method of signal limitation, in other words, decreasing signal strength before passing the node and increasing signal strength after being processed through the node.

In some embodiments, the voltage multiplier 300 is implemented in a parallel connection to a bypass, for instance to a switch 320, as is visualized by FIGS. 3 to 6. The switch 320 may be comprised by the ASIC 220. The switch 320 may comprise, for example, a mechanical switch or a transistor. If the switch 320 is deactivated, the voltage multiplier 300 may receive the supply voltage 290 from an external source and provide the internal supply voltage 310 to the source follower 230. If the switch 320 is activated, the voltage multiplier 300 may be bypassed, and the external supply voltage 290 is provided to the source follower 230. In other words, the circuit assembly 200 may be sent into a low-power mode by activating the switch 320. This way it may be possible to activate or deactivate the voltage multiplier 300 according to individual requirements, for instance, if the signal strength does not exceed a predefined level, and an activation of the voltage multiplier is not necessary. This may lead to reduced power dissipation during the low-power mode. Possible applications may, for instance, comprise a low power module for a mobile phone.

Figure 3:
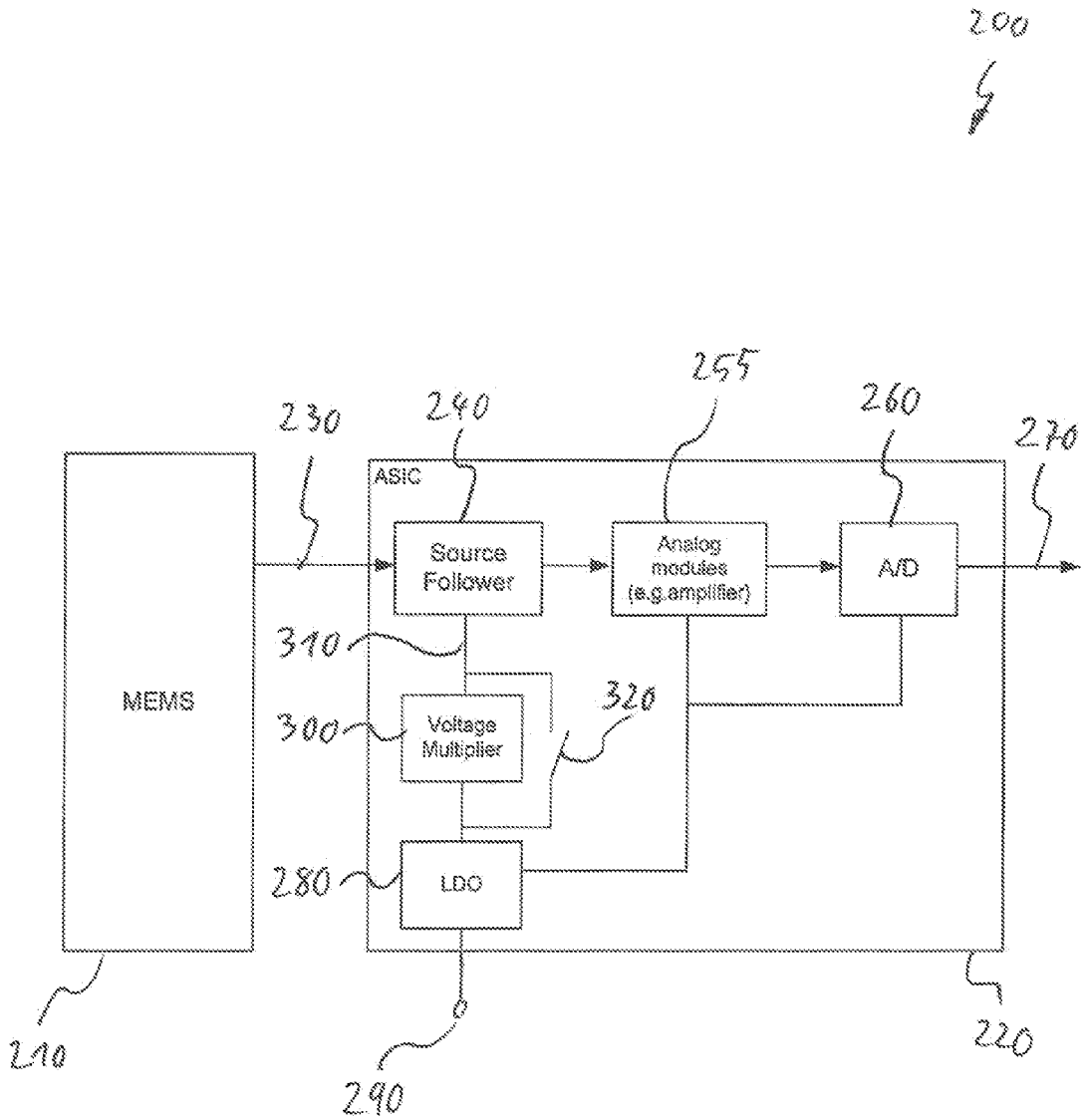
FIG. 3 shows a block diagram of a circuit assembly for processing an input signal from a microphone according to a second embodiment.
Figure 4:
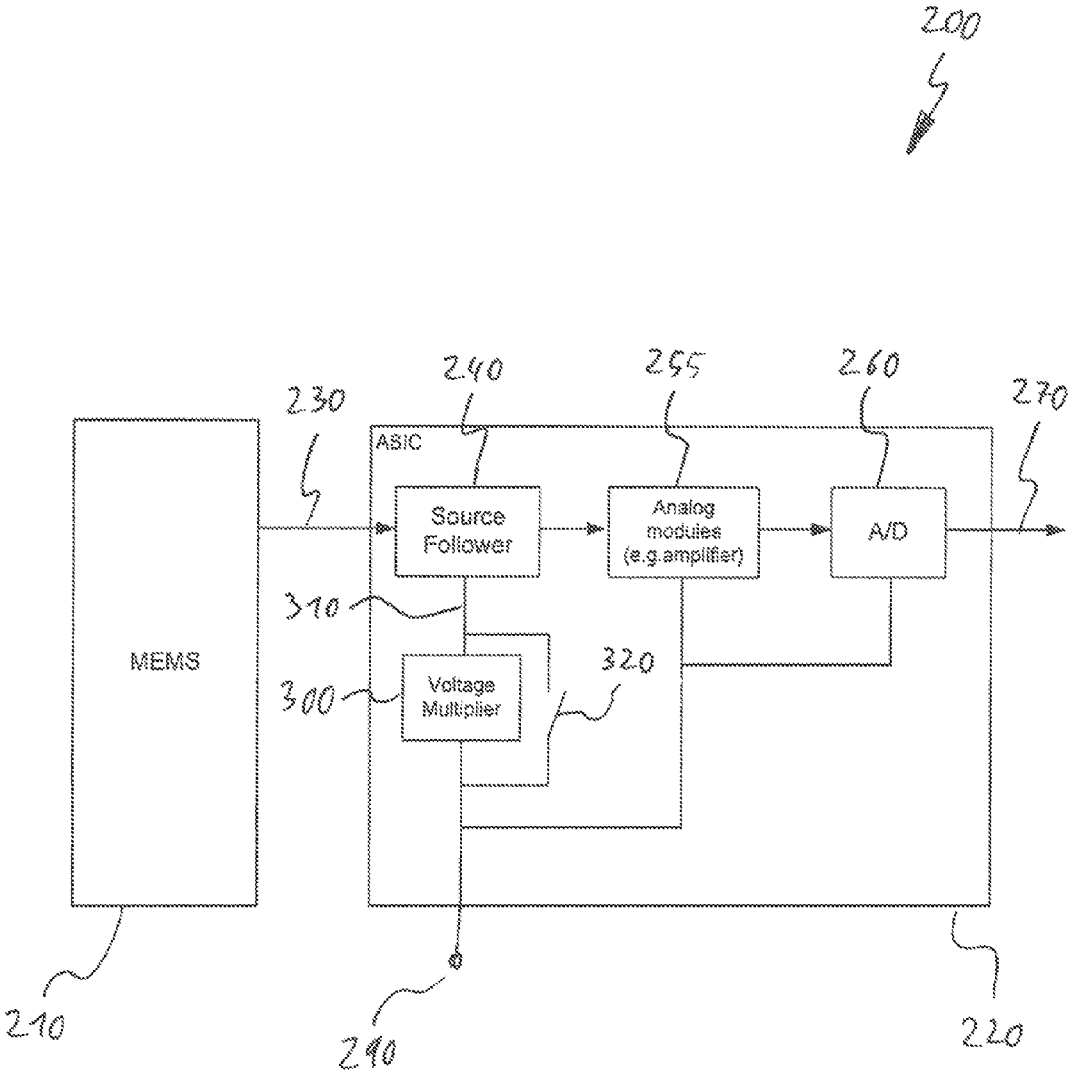
FIG. 4 shows a block diagram of a circuit assembly for processing an input signal from a microphone according to a third embodiment.
Figure 5:
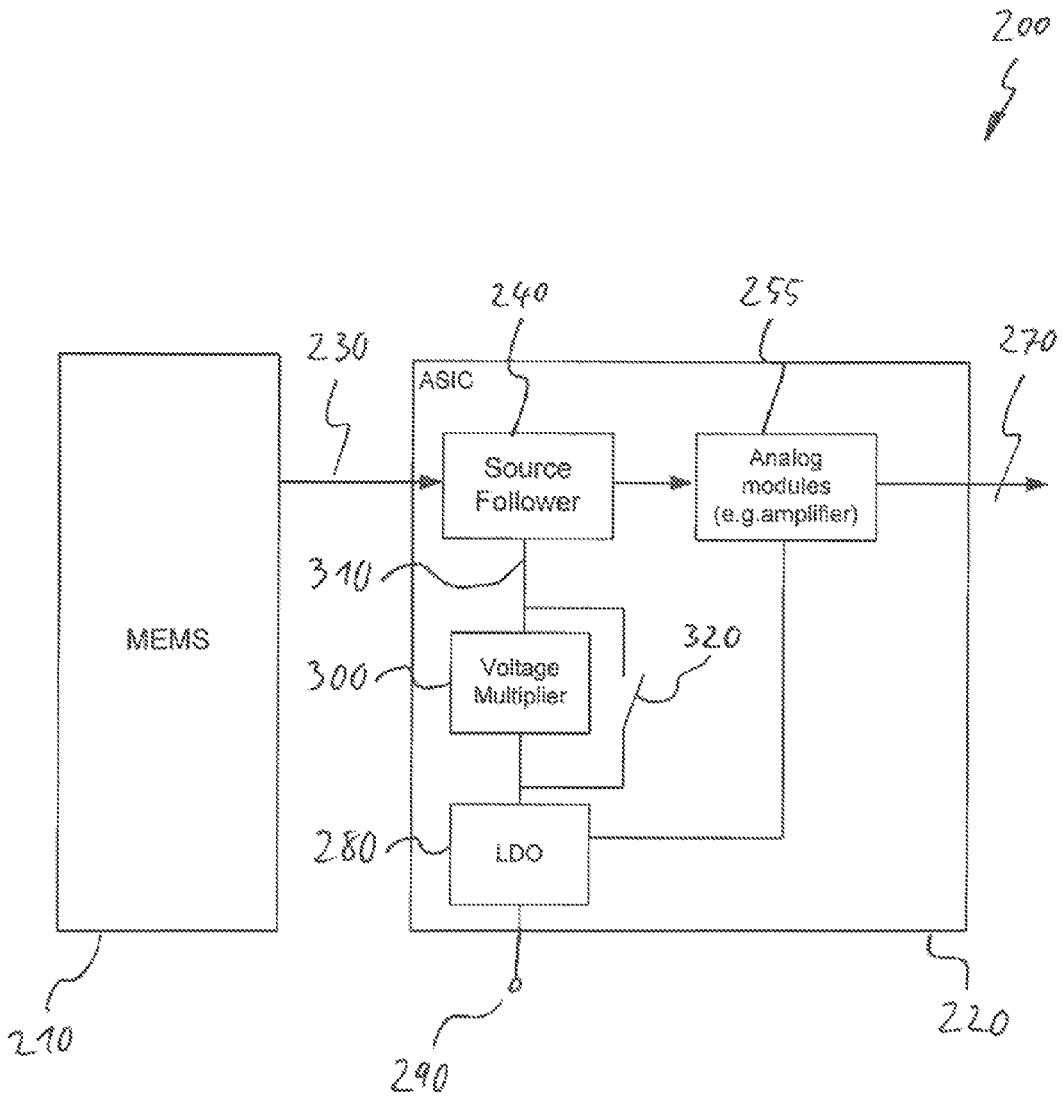
FIG. 5 shows a block diagram of a circuit assembly for processing an input signal from a microphone according to a fourth embodiment.
Figure 6:
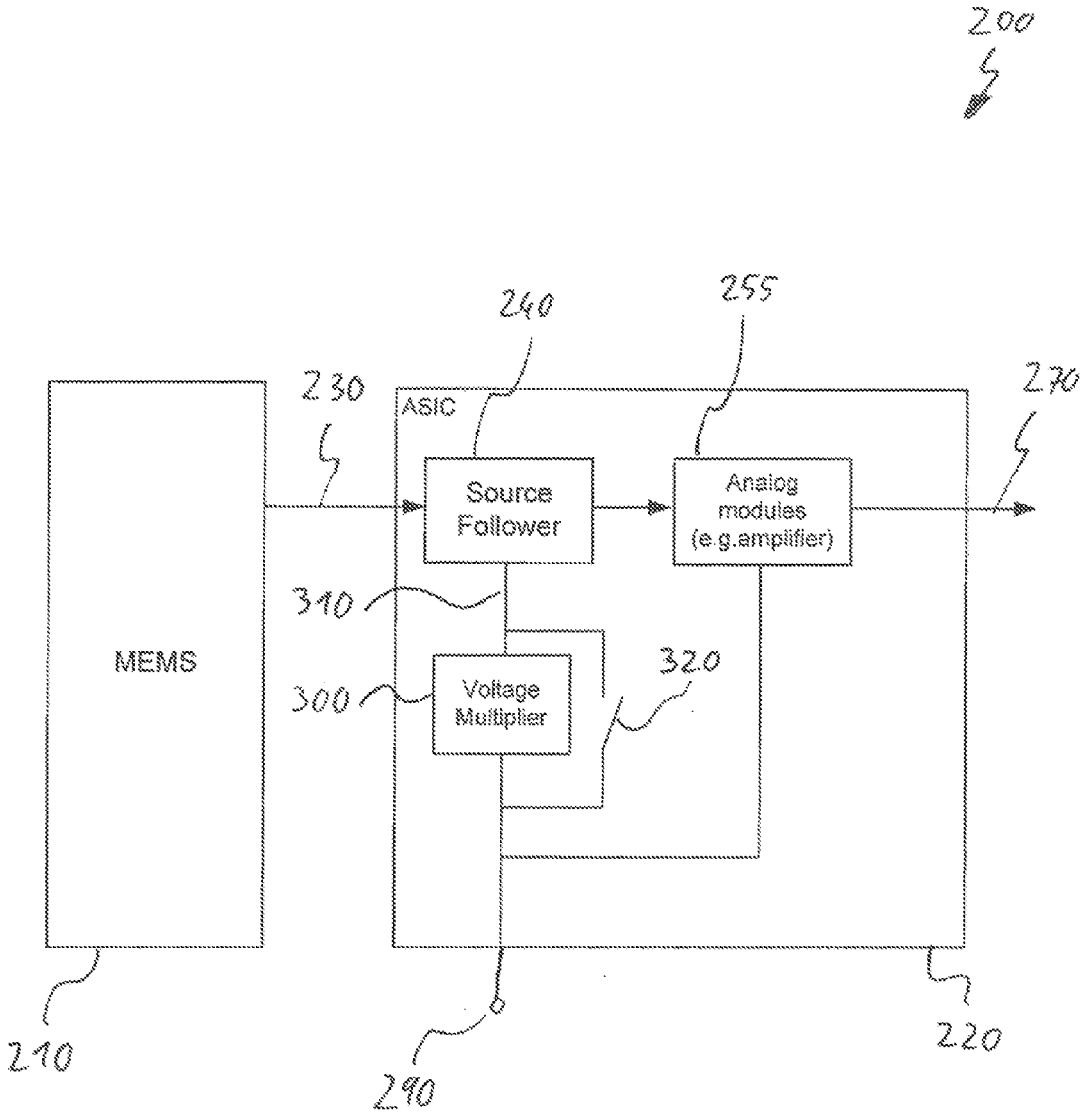
FIG. 6 shows a block diagram of a circuit assembly for processing an input signal from a microphone according to a fifth embodiment.

Some embodiments refer to a circuit assembly 200, which comprises a LDO 280, as is shown in FIGS. 2, 3 and 5. The LDO 280 may stabilize the external supply voltage 290, or may, for example, in case of peaks or drops of the supply voltage 290 provide a voltage which may be constant within the limits of production tolerance or environmental influences. Further, the LDO 280 may suppress perturbations in the supply voltage 290, which may also be referred to as "power supply rejection." The LDO 280 may be optionally implemented. In other embodiments, as is shown in FIGS. 4 and 6, the supply voltage 290 is directly provided to the voltage multiplier 300 and the at least one analog module 255. The LDO 280 may be comprised by the ASIC 220.

Some embodiments may be implemented for digital applications, or in other words, the circuit assembly 200 may provide the microphone signal 270 in digital form. For this purpose, the circuit assembly 200 may further comprise an ADC 260, which is shown in FIGS. 2 to 4. In some embodiments, the ADC 260 is comprised by the ASIC 220. The ADC 260 may receive the analog signal from the source follower 240 directly or via an analog module 255 and provide a digital output signal. Further, the ADC 260 may receive the supply voltage 290 directly from an external source, or via the optionally implemented LDO 280. Embodiments may thus be implemented for analog or digital microphone applications, possibly allowing for more flexible usage.

Further embodiments refer to a microphone assembly. The microphone assembly comprises a microphone configured to provide a raw microphone signal. The microphone assembly further comprises a circuit assembly for processing an input signal. The circuit assembly comprises a voltage multiplier configured to receive a supply voltage and to provide an internal supply voltage higher than the supply voltage. The circuit also comprises a signal follower coupled to an output port of the voltage provider. The signal follower is configured to receive the internal supply voltage and the raw microphone signal as an input signal, and to provide an output signal depending on the input signal. In some embodiments, the microphone assembly may comprise a MEMS. In one or more embodiments, the microphone and circuit assembly is integrated within a common package, or within a common chip or die. For instance, with respect to FIGS. 2 to 6, the MEMS 210 and the ASIC 220 may be integrated in a common package.

Figure 7:
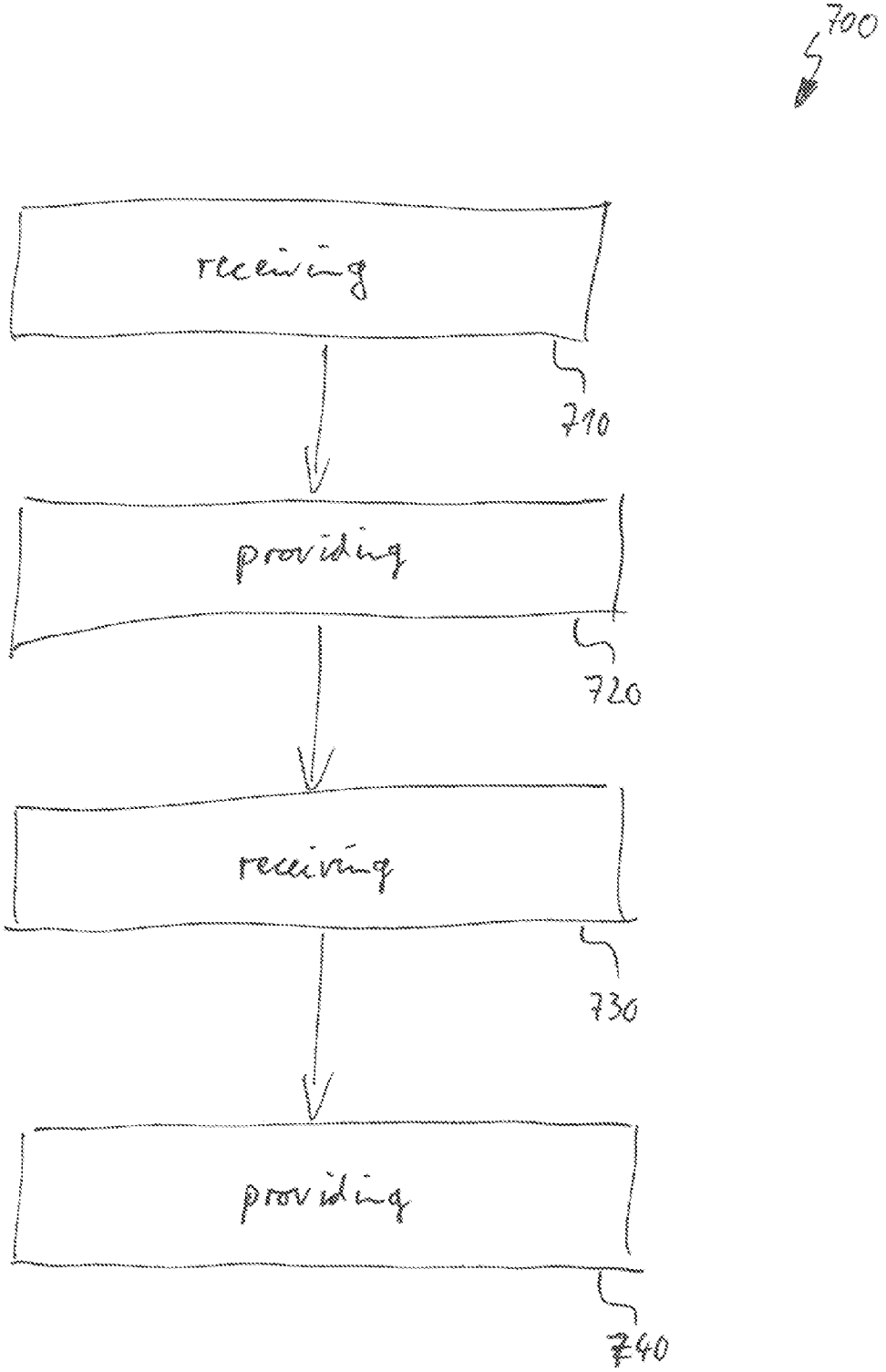
FIG. 7 shows a flow chart of a method for following an input signal according to an embodiment.

FIG. 7 shows a flow chart of a method 700 for following an input signal. The method 700 comprises a receiving 710 of a supply voltage. The method 700 also comprises a providing 720 of an internal supply voltage using the supply voltage, the internal supply voltage being higher than the supply voltage. The method 700 further comprises a receiving 730 of the input signal. Furthermore, the method 700 comprises a providing 740 of an output signal, the output signal depending on the input signal and the internal supply voltage.

The description and drawings merely illustrate the principles of the embodiments of the invention. It will thus be appreciated that those skilled in the art will be able to devise various arrangements that, although not explicitly described or shown herein, embody the principles of the invention and are included within its spirit and scope. Furthermore, all examples recited herein are principally intended expressly to be only for pedagogical purposes to aid the reader in understanding the principles of the embodiments of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

Functional blocks denoted as "means for . . . " (performing a certain function) shall be understood as functional blocks comprising circuitry that is adapted for performing a certain function, respectively. Hence, a "means for s.th." may as well be understood as a "means being adapted or suited for s.th." A means being adapted for performing a certain function does, hence, not imply that such means necessarily is performing said function (at a given time instant).

Functions of various elements shown in the figures, including any functional blocks labeled as "means," "means for" etc., may be provided through the use of dedicated hardware, such as "a processor," "a controller," etc. as well as hardware capable of executing software in association with appropriate software. Moreover, any entity described herein as "means," may correspond to or be implemented as "one or more modules," "one or more devices," "one or more units," etc. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, network processor, application specific integrated circuit (ASIC), field programmable gate array (FPGA), read only memory (ROM) for storing software, random access memory (RAM), and non-volatile storage. Other hardware, conventional and/or custom, may also be included.

It should be appreciated by those skilled in the art that any block diagrams herein represent conceptual views of illustrative circuitry embodying the principles of the invention. Similarly, it will be appreciated that any flow charts, flow diagrams, state transition diagrams, pseudo code, and the like represent various processes which may be substantially represented in computer readable medium and so executed by a computer or processor, whether or not such computer or processor is explicitly shown.

Furthermore, the following claims are hereby incorporated into the Detailed Description, where each claim may stand on its own as a separate embodiment. While each claim may stand on its own as a separate embodiment, it is to be noted that—although a dependent claim may refer in the claims to a specific combination with one or more other claims—other embodiments may also include a combination of the dependent claim with the subject matter of each other dependent claim. Such combinations are proposed herein unless it is stated that a specific combination is not intended. Furthermore, it is intended to include also features of a claim to any other independent claim even if this claim is not directly made dependent to the independent claim.

It is further to be noted that methods disclosed in the specification or in the claims may be implemented by a device having means for performing each of the respective steps of these methods.

Further, it is to be understood that the disclosure of multiple steps or functions disclosed in the specification or claims may not be construed as to be within the specific order. Therefore, the disclosure of multiple steps or functions will not limit these to a particular order unless such steps or functions are not interchangeable for technical reasons. Furthermore, in some embodiments a single step may include or may be broken into multiple sub steps. Such sub steps may be included and part of the disclosure of this single step unless explicitly excluded.

What is claimed is:

1. A circuit assembly for processing an input signal, comprising:

a voltage provider configured to receive a supply voltage and to provide an internal supply voltage higher than the supply voltage; and a signal follower coupled to an output port of the voltage provider, the signal follower being configured to receive the internal supply voltage and the input signal, and to provide an output signal depending on the input signal.

2. The circuit assembly according to claim 1, further comprising a bypass paralleling the voltage provider so that the signal follower is configured to receive the supply voltage instead of the internal supply voltage when the bypass is activated.

3. The circuit assembly according to claim 1, further comprising a low-dropout regulator (LDO) configured to receive and to regulate an external supply voltage and to provide the supply voltage to the voltage provider.

4. The circuit assembly according to claim 1, further comprising an amplifier configured to receive the output signal and to provide an amplified output signal.

5. The circuit assembly according to claim 1, further comprising an analog-to-digital converter (ADC) configured to receive the output signal or an amplified output signal and to provide a digital signal.

6. The circuit assembly according to claim 1, wherein the circuit assembly is implemented within an application-specific integrated circuit (ASIC).

7. The circuit assembly according to claim 1, wherein the voltage provider is a voltage multiplier.

8. The circuit assembly according to claim 1, wherein the signal follower is a source follower.

9. The circuit assembly according to claim 1, wherein the input signal is a microphone signal provided by a microphone.

10. A microphone assembly comprising:

a microphone configured to provide a raw microphone signal;

a circuit assembly for processing an input signal, the circuit assembly comprising a voltage provider configured to receive a supply voltage and to provide an internal supply voltage higher than the supply voltage; and a signal follower coupled to an output port of the voltage provider, the signal follower being configured to receive the internal supply voltage and the raw microphone signal as an input signal, and to provide an output signal depending on the input signal.

11. The microphone assembly according to claim 10, wherein the microphone comprises a microelectromechanical system (MEMS).

12. The microphone assembly according to claim 10, wherein the microphone and the circuit assembly are integrated within a common package.

* * * * *